US008568019B2

(12) United States Patent
Waldron et al.

(10) Patent No.: US 8,568,019 B2
(45) Date of Patent: Oct. 29, 2013

(54) MIXING APPARATUS FOR MANUFACTURING AN EMULSIFIED FUEL

(75) Inventors: Jack L. Waldron, Reno, NV (US); Patrick Grimes, Reno, NV (US)

(73) Assignee: Talisman Capital Talon Fund, Ltd., Little Rock, AK (US)

( * ) Notice: Subject to any disclaimer, the term of this patent is extended or adjusted under 35 U.S.C. 154(b) by 0 days.

(21) Appl. No.: 13/487,143

(22) Filed: Jun. 1, 2012

(65) Prior Publication Data

US 2012/0281496 A1 Nov. 8, 2012

Related U.S. Application Data

(60) Continuation of application No. 12/872,699, filed on Aug. 31, 2010, now Pat. No. 8,192,073, which is a division of application No. 11/853,548, filed on Sep. 11, 2007, now abandoned, which is a division of application No. 10/754,885, filed on Jan. 9, 2004, now abandoned.

(51) Int. Cl.
*B01F 5/06* (2006.01)

(52) U.S. Cl.
USPC ..... 366/181.5; 366/340

(58) Field of Classification Search
USPC ..... 366/167.1, 181.5, 336–341, DIG. 1, 366/DIG. 2, DIG. 3, 176.1, 173.1, 173.2, 366/174.1, 175.2; 48/189.4; 138/37–40, 138/42–44, 46
See application file for complete search history.

(56) References Cited

U.S. PATENT DOCUMENTS

| | | | | | |
|---|---|---|---|---|---|
| 10,516 | A | * | 2/1854 | Griffiths | 137/243.1 |
| 44,164 | A | * | 9/1864 | Cupper | 251/274 |
| 52,521 | A | * | 2/1866 | Broughton | 251/273 |
| 61,758 | A | * | 2/1867 | Powell | 137/243.4 |
| 77,913 | A | * | 5/1868 | Powell | 137/243.4 |
| 547,506 | A | * | 10/1895 | Sleigh et al. | 251/276 |
| 1,237,222 | A | * | 8/1917 | Schroder | 366/286 |
| 1,690,667 | A | * | 11/1928 | China | 241/21 |
| 1,848,531 | A | * | 3/1932 | Lamb et al. | 366/176.2 |
| 1,925,787 | A | * | 9/1933 | Brooks | 366/176.2 |
| 1,987,944 | A | * | 1/1935 | Rafton | 241/21 |
| 2,132,854 | A | * | 10/1938 | Knott | 138/42 |
| 2,504,678 | A | * | 4/1950 | Gardner | 366/336 |

(Continued)

FOREIGN PATENT DOCUMENTS

| | | | |
|---|---|---|---|
| JP | 2001321652 A | * | 11/2001 |
| JP | 2009-112891 | | 5/2009 |

(Continued)

OTHER PUBLICATIONS

International Search Report and Written Opinion mailed Jan. 4, 2006 in corresponding International Patent Application No. PCT/US2005/000318 filed Jan. 5, 2005 entitled Apparatus and Method for Manufacturing an Emulsified Fuel.

(Continued)

*Primary Examiner* — Charles E Cooley
(74) *Attorney, Agent, or Firm* — Lewis and Roca LLP

(57) ABSTRACT

A mixing apparatus is disclosed. The mixing apparatus comprises a mixing device having a constant flow area. The mixing device is configured to create a shearing environment. Several types of mixing apparatus are disclosed. Methods for producing aqueous fuel emulsions with consistently uniform dispersed phase particle sizes using a mixing apparatus are also disclosed.

11 Claims, 4 Drawing Sheets

(56) References Cited

U.S. PATENT DOCUMENTS

| | | | | | |
|---|---|---|---|---|---|
| 2,591,966 | A | * | 4/1952 | Rider | 366/286 |
| 2,652,234 | A | * | 9/1953 | Feldmann | 366/339 |
| 2,817,500 | A | * | 12/1957 | Robinson | 241/33 |
| 2,995,346 | A | * | 8/1961 | Samples | 366/98 |
| 3,105,570 | A | | 10/1963 | Nicholas | |
| 3,179,385 | A | * | 4/1965 | Deackoff | 426/519 |
| 3,473,787 | A | * | 10/1969 | Bartlett | 366/176.2 |
| 3,514,079 | A | * | 5/1970 | Little, Jr. | 366/305 |
| 3,545,492 | A | | 12/1970 | Scheid | |
| 3,582,048 | A | * | 6/1971 | Sarem | 366/340 |
| 3,583,678 | A | * | 6/1971 | Harder | 366/340 |
| 3,658,266 | A | * | 4/1972 | O'Keefe et al. | 241/101.2 |
| 3,665,965 | A | * | 5/1972 | Baumann | 138/42 |
| 4,000,086 | A | * | 12/1976 | Stoev et al. | 516/53 |
| 4,344,752 | A | * | 8/1982 | Gallagher, Jr. | 431/354 |
| 4,441,823 | A | | 4/1984 | Power | |
| 4,488,704 | A | * | 12/1984 | Wicker | 251/265 |
| 4,665,950 | A | | 5/1987 | Fruh | |
| 4,869,849 | A | | 9/1989 | Hirose et al. | |
| 4,874,248 | A | * | 10/1989 | Luetzelschwab | 366/307 |
| 4,890,927 | A | * | 1/1990 | Salvaire et al. | 366/1 |
| 4,971,450 | A | * | 11/1990 | Gerich | 366/340 |
| 5,327,941 | A | * | 7/1994 | Bitsakis et al. | 138/42 |
| 5,341,848 | A | * | 8/1994 | Laws | 138/44 |
| 5,366,287 | A | * | 11/1994 | Verstallen | 366/162.4 |
| 5,366,288 | A | * | 11/1994 | Dahllof et al. | 366/176.2 |
| 5,482,369 | A | * | 1/1996 | Verstallen | 366/162.4 |
| 5,529,093 | A | * | 6/1996 | Gallagher et al. | 138/44 |
| 5,575,561 | A | * | 11/1996 | Rohwer | 366/336 |
| 5,762,107 | A | * | 6/1998 | Laws | 138/44 |
| 5,782,557 | A | * | 7/1998 | Young | 366/176.2 |
| 5,873,916 | A | | 2/1999 | Cemenska et al. | |
| 5,902,042 | A | * | 5/1999 | Imaizumi et al. | 366/176.2 |
| 5,984,519 | A | * | 11/1999 | Onodera et al. | 366/340 |
| 6,145,544 | A | * | 11/2000 | Dutertre et al. | 138/39 |
| 6,186,179 | B1 | * | 2/2001 | Hill | 138/39 |
| 6,383,237 | B1 | | 5/2002 | Langer et al. | |
| 6,386,750 | B2 | | 5/2002 | Marelli | |
| 6,502,979 | B1 | * | 1/2003 | Kozyuk | 366/176.2 |
| 6,705,755 | B1 | * | 3/2004 | Innings et al. | 366/176.1 |
| 6,807,986 | B2 | * | 10/2004 | Boger | 138/44 |
| 6,880,579 | B2 | | 4/2005 | Boger | |
| 7,051,765 | B1 | * | 5/2006 | Kelley et al. | 138/44 |
| 7,073,534 | B2 | * | 7/2006 | Sawchuk et al. | 138/39 |
| 7,344,570 | B2 | * | 3/2008 | Moncrieff et al. | 44/301 |
| 7,621,670 | B1 | * | 11/2009 | England et al. | 366/340 |
| 8,192,073 | B1 | * | 6/2012 | Waldron et al. | 366/340 |
| 8,262,748 | B2 | * | 9/2012 | Moncrieff et al. | 44/301 |
| 2003/0165081 | A1 | * | 9/2003 | Mizutani et al. | 366/340 |
| 2004/0160855 | A1 | * | 8/2004 | Rivolta et al. | 366/176.2 |
| 2005/0000149 | A1 | * | 1/2005 | Moncrieff et al. | 44/301 |
| 2005/0150155 | A1 | * | 7/2005 | Waldron et al. | 44/301 |
| 2006/0096650 | A1 | * | 5/2006 | Sawchuk et al. | 138/39 |
| 2007/0294935 | A1 | * | 12/2007 | Waldron et al. | 44/301 |
| 2008/0295389 | A1 | * | 12/2008 | Moncrieff et al. | 44/301 |
| 2009/0141584 | A1 | * | 6/2009 | Boer et al. | 366/336 |
| 2010/0243953 | A1 | * | 9/2010 | Livshits | 252/182.11 |
| 2010/0319799 | A1 | * | 12/2010 | McCarty | 138/42 |
| 2011/0174407 | A1 | * | 7/2011 | Lundberg et al. | 138/37 |
| 2012/0188842 | A1 | * | 7/2012 | Smith | 366/150.1 |
| 2012/0281496 | A1 | * | 11/2012 | Waldron et al. | 366/340 |
| 2013/0036659 | A1 | * | 2/2013 | Moncrieff et al. | 44/301 |

FOREIGN PATENT DOCUMENTS

| | | | |
|---|---|---|---|
| JP | 2009-247715 | * | 10/2009 |
| WO | WO 02/096544 | | 12/2002 |
| WO | WO 2005/070046 A2 | | 8/2005 |
| WO | WO 2005/070046 A3 | | 8/2005 |

OTHER PUBLICATIONS

U.S. Appl. No. 10/754,885 Final Office Action dated Jun. 11, 2007.
U.S. Appl. No. 10/754,885 Final Office Action dated Mar. 7, 2007.
U.S. Appl. No. 10/754,885 Office Action dated Nov. 22, 2006.
U.S. Appl. No. 10/754,885 Office Action dated Aug. 10, 2006.
U.S. Appl. No. 10/754,885 Office Action dated Mar. 24, 2006.
U.S. Appl. No. 11/853,548 Final Office Action dated Feb. 4, 2011.
U.S. Appl. No. 11/853,548 Office Action dated Sep. 13, 2010.
U.S. Appl. No. 12/872,565 Office Action dated Jan. 13, 2011.
U.S. Appl. No. 12/872,669 Final Office Action dated Mar. 4, 2011.
U.S. Appl. No. 12/872,669 Office Action dated Oct. 14, 2010.

* cited by examiner

MIXING APPARATUS FOR MANUFACTURING AN EMULSIFIED FUEL

CROSS-REFERENCE TO RELATED APPLICATIONS

This application is a continuation and claims the priority benefit of U.S. patent application Ser. No. 12/872,699, filed Aug. 31, 2010, now U.S. Pat. No. 8,192,073, which is a divisional and claims the priority benefit of U.S. patent application Ser. No. 11/853,548, filed Sep. 11, 2007 now abandoned, which is a divisional and claims the priority benefit of U.S. patent application Ser. No. 10/754,885, filed Jan. 9, 2004 now abandoned, the entirety of which is incorporated by reference herein.

BACKGROUND OF THE INVENTION

The present invention relates to a mixing device for manufacturing an aqueous fuel, and more particularly to a specially designed mixing device that creates a superior aqueous fuel emulsion from a hydrocarbon fuel, water, and an aqueous fuel emulsifier package.

Recent fuel developments have resulted in a number of aqueous fuel emulsions comprised essentially of a carbon-based fuel, water, and various additives, such as lubricants, emulsifiers, surfactants, corrosion inhibitors, cetane improvers, and the like. These aqueous fuel emulsions may play a key role in finding a cost-effective way for internal combustion engines including, but not limited to, compression ignition engines (i.e., diesel engines) to achieve the reduction in emissions below the mandated levels without significant modifications to the engines, fuel systems, or existing fuel delivery infrastructure.

Advantageously, aqueous fuel emulsions tend to reduce or inhibit the formation of nitrogen oxides (NOx) and particulates (i.e., combination of soot and hydrocarbons) by altering the way the fuel is burned in the engine. Specifically, the fuel emulsions are burned at lower temperatures than conventional fuels due to the presence of water. This, coupled with the realization that at higher peak combustion temperatures more NOx are typically produced in the engine exhaust, one can readily understand the advantage of using aqueous fuel emulsions.

As is well known in the art, the constituent parts of such aqueous fuel emulsions have a tendency to separate or be unstable over time because of the different densities or relative weights of the primary components, as well as other factors including the immiscibility of the compounds. As an example, middle distillate hydrocarbon sources have a density of about 0.85 while water sources have a density of about 1.0. Because the gravitational driving force for phase separation is more prominent for larger droplets of water, emulsions containing relatively smaller droplets of water will remain stable for longer periods of time. Aqueous fuel emulsion breakdown or phase separation is also influenced by how quickly the water droplets coalescence, or flocculate. The emulsion breakdown is also influenced by the environment in which the aqueous fuel is subjected. Any breakdown in the aqueous fuel emulsion can be extremely damaging if not detected before use in combustion. Given the microscopic nature of the suspended particles with the discontinuous phase, aqueous fuel emulsions can look acceptable to the naked eye but can actually be considered unacceptable when subjected to quality control standards to one skilled in the art.

Determining the amount of the emulsifier necessary for creating a specific emulsion of a water source and a hydrocarbon source can generally be calculated with calculations common to the art based on material densities, particle sizes of the discontinuous phase, etc. Such measurements are typically summarized in a particle distribution curve of the discontinuous phase.

It is commonly recognized that aqueous fuel emulsions can be produced by mixing a liquid hydrocarbon source, an emulsifier source, and a water source. The art of making aqueous fuel emulsions basically relates to three aspects:

1) The specific chemistries of the aqueous fuel emulsifier;
2) The specific sequences in which each of the ingredients (or portions thereof) are mixed with the other ingredients (or portions thereof); and
3) The specific mechanical mixing procedures of the ingredients.

Chemistries for emulsifiers are generally composed of surfactants or soaps, among other things, that comprise a mixture of at least two components: one that is predominantly hydrocarbon soluble and the other that is predominantly water soluble so that the surfactant is balanced such that the interfacial tension between the hydrocarbon and water phases is substantially zero. In other words, each of these chemistries plays a critical role in breaking down the surface tension between the oil and water so a bond can form between the different molecules and to help disperse the water particles (from attracting to each other in the case of an oil phase). This is basically completed through three different types of electrical charged chemistries referred to as cationic (positive charge), anionic (negative charge) and non-ionic (neutral charge), or combinations thereof.

In many cases the emulsifier packages are designed to be soluble in the discontinuous phase. The amount of the emulsifier as a percent of the aqueous emulsified fuel will vary based on several factors which include the type and amount of continuous and discontinuous phase, the chemical composition of the emulsifier, and the particle sizes of the discontinuous phase.

While a range of different sequences have been recognized, it is generally understood that the principles of aqueous fuel emulsions dictate that the emulsifier supply should be mixed with the external phase of the aqueous fuel emulsion first (or portions thereof) and then with the discontinuous phase (or portions thereof) second.

For example, in the case of an oil-phased emulsion, the emulsifier supply would be first mixed with the hydrocarbon source before it is mixed with the discontinuous phase of water. Conversely, in a water-phased emulsion the emulsifier supply would be first mixed with the water source (or portions thereof) before it is mixed with the discontinuous phase of hydrocarbon fuel (or portions thereof). In the case where portions are premixed, the balance is introduced at a subsequent point as the aqueous fuel emulsion is manufactured.

While there can be several mixing stations during the emulsification process, a high-shear mixing stage is usually required when a water source is mixed with a hydrocarbon fuel source. Prior to the high-shear mixing, the various stages can be mixed with less intense mixing devices, such as in-line mixers or other common liquid agitators, because the chemicals being mixed have relatively compatible chemical properties. Because of the very different chemical properties of water and oil, significant amounts of mechanical energy are required to reduce the discontinuous phase to sizes where they can contribute to a stable aqueous fuel emulsion.

To date, high-shear mixers such as commercially available rotor-stator units and ultrasonic devices have been commonly referenced despite the fact that they were designed and sold primarily for the emulsification of non petroleum-related products such as foods products, cosmetic products and chemical products.

Several related art references have disclosed specific high shear devices for producing or blending a fuel emulsion. For example, U.S. Pat. No. 6,383,237 to Langer discloses the use of a rotor-stator mixer, when the hydrocarbon and water source are mixed, as does U.S. Pat. No. 5,873,916 to Cemenska. In both patents, the use of the commercially available high shear devices from well-recognized companies in the fluid agitation industry as part of their multi-step and multi-sequence fuel emulsion blending systems is disclosed.

Rotor stators basically provide shearing by a combination of a spinning blade, flow forced through a screen and/or a combination of both. Because the particle size of the discontinuous phase is largely determined by the shear rate of the high shear mixer, it is common for the discontinuous phase to have a wide range of particle sizes as a given portion is cut with the blade, a different portion is forced through a screen and another portion is subjected to both. To compensate for this occurrence many high shear mixers include dual or multiple staged rotor mixers or looped circuits, which allow aqueous fuel ingredients to be subjected to additional shear thereby increasing the population of uniform dispersed phase particle sizes. However, these additional high shear mixing devices or looped systems are more expensive and less efficient in terms of volume output, and are difficult to control correctly.

Despite the widespread use of high shear mixers in the aqueous fuel emulsion industry as well as other participants in the fluid agitation industry, there is almost no fundamental basis by which to theoretically predict or experimentally assess their performance. This fundamental is better illustrated through a general review of the shear rate and its calculation.

Shear is a force that is applied parallel to a surface, as illustrated in FIG. 1.

The forces are opposite as the square has to be in static equilibrium. This shear tends to elongate a solid, and in a liquid tends to create turbulence and eddies.

The shear formula that has been used for analysis of the physical processes in making emulsified fuels is as follows in FIG. 2 and Equation 1:

$$\text{Shear force} = \frac{VAu}{Bgc} \qquad \text{Equation 1}$$

Where:

V is the velocity of the moving plate

A is the area of the plate u is the viscosity of the fluid in question gc is the gravitational constant, 32.2 ft/sec B is the separation distance between plates.

This equation was developed and is commonly used to determine the viscosity of liquids by measuring the force created by rotating a plate in the fluid of question. It is also directly applicable to any situation where one plate is moving in relation to another, such as in a colloid mill.

For flow between two surfaces, the physical situation is as follows in FIG. 3 and Equation 2:

$$\text{Shear force} = \frac{2VAu}{Bgc} \qquad \text{Equation 2}$$

Where:

V is the velocity of the moving plate

A is the area of the plate u is the viscosity of the fluid in question gc is the gravitational constant, 32.2 ft/sec B is the separation distance between plates.

Although the linear velocity profile is an approximation (it is known that the velocity profile is parabolic in nature) it does provide a method for comparative calculation. As shear is present on both plates, the total shear force exerted on the fluid is about two times that from Equation 1.

One needs to recognize the fact that these calculations are not precise, as there are assumptions in their creation and in their application. However, these calculations illustrate the basic forces in fluid shear and can be used to develop relative force values for different shear modes.

Due to the rather imprecise methods available to calculate shear in commercially available unit scale-up and operation of these high-shear units as a component of a blending process of the aqueous fuel emulsions is generally completed by trial and error. Consequently, many of the commercial blending units available for blending aqueous fuel emulsions are configured around the limitations of the commercially available high shear units. This is one of the reasons the commercial aqueous fuel emulsion blending units require recirculation capabilities or multi-staged shearing (despite their higher costs or impact on lower capacity) to enable the water particles to be reduced to the desired particle size.

Because of problems inherent with the commercially available high shear mixing units such as the rotor stator, the effectiveness of the shear mixing units can only be varied by controlling the rate and frequency in which the emulsion material is subjected to high shear mixing. As stated above, the commercially available units may not be capable of creating a consistently uniform family of particle sizes of the discontinuous phase in the most practical and cost effective manner. This can create a fairly wide distribution curve for a family of particle sizes of water and in most cases creates a bi-modal curve. Having a consistent discontinuous phase particle size is not only important to create the foundation for a stable emulsion but it is critical in determining the required amount of emulsifier that is required. Consequently, it would be desirous to have a mixing system that creates a more uniform population of particle sizes of the discontinuous phase. A narrower particle distribution curve thereby creates an even distribution of the emulsifier sources between hydrocarbon source and the water source.

SUMMARY OF THE CLAIMED INVENTION

The present invention addresses the aforementioned problems by incorporating a specially designed mixing unit into a blending system and method for producing aqueous fuel emulsions with consistently uniform dispersed phase particle sizes with a relatively inexpensive mixing device. Specifically, the present invention relates to a specially designed mixing device that creates an aqueous fuel emulsion from a source of hydrocarbon fuel, a source of water, and a source of said aqueous fuel emulsifier package by incorporating a small area high velocity-mixing device that produces the appropriate mixing environment for the individual compounds to make an aqueous fuel with relatively homogenous particle sizes of the discontinuous phase.

A mixing apparatus is disclosed. The mixing apparatus comprises a mixing device having a constant flow area. The mixing device is configured to create a shearing environment.

Another mixing apparatus is disclosed. The mixing apparatus comprises a fluid shear generator body having a first cavity with an inlet having a predetermined flow area and a second cavity with an outlet having a predetermined flow area. The first cavity has an inlet configured to receive liquids and the second cavity has an outlet configured to couple the liquids mixed in the fluid shear generator body. The mixing apparatus also comprises a shear cone disposed between the first cavity and the second cavity. The mixing apparatus also comprises a shear cone seat disposed between the first cavity and the second cavity. The shear cone seat matingly receives the shear cone and the shear cone seat is parallel to an upper surface of the shear cone. The mixing apparatus also comprises a control stem integral with the shear cone. The control stem is configured to adjust the shear cone. The control stem is configured to control a gap between the shear cone and a shear cone seat with the gap having a predetermined flow area.

Another mixing apparatus is disclosed. The mixing apparatus comprises a disc body having a first face and a second face opposite the first face. The disc body has a disc wall disposed between the first face and the second face. The mixing apparatus also comprises at least one flow passage extending through the disc body from the first face to the second face. The at least one flow passage has a constant flow area. The disc body is configured to shear a fluid flowing through the at least one flow passage.

A method of producing aqueous fuel emulsions with consistently uniform dispersed phase particle sizes using a mixing apparatus is disclosed. The method comprises disposing aqueous fuel emulsion producing liquids into a mixing device. The mixing device can be either mixing apparatus as discussed above. The method also comprises flowing the aqueous fuel emulsion-producing liquids through a constant flow area of the mixing device.

BRIEF DESCRIPTION OF THE FIGURES

Referring now to the figures, wherein like elements are numbered alike.

DETAILED DESCRIPTION

Those of ordinary skill in the art will realize that the following description is illustrative only and not in any way limiting. Other embodiments will readily suggest themselves to such skilled persons.

Figure 4:
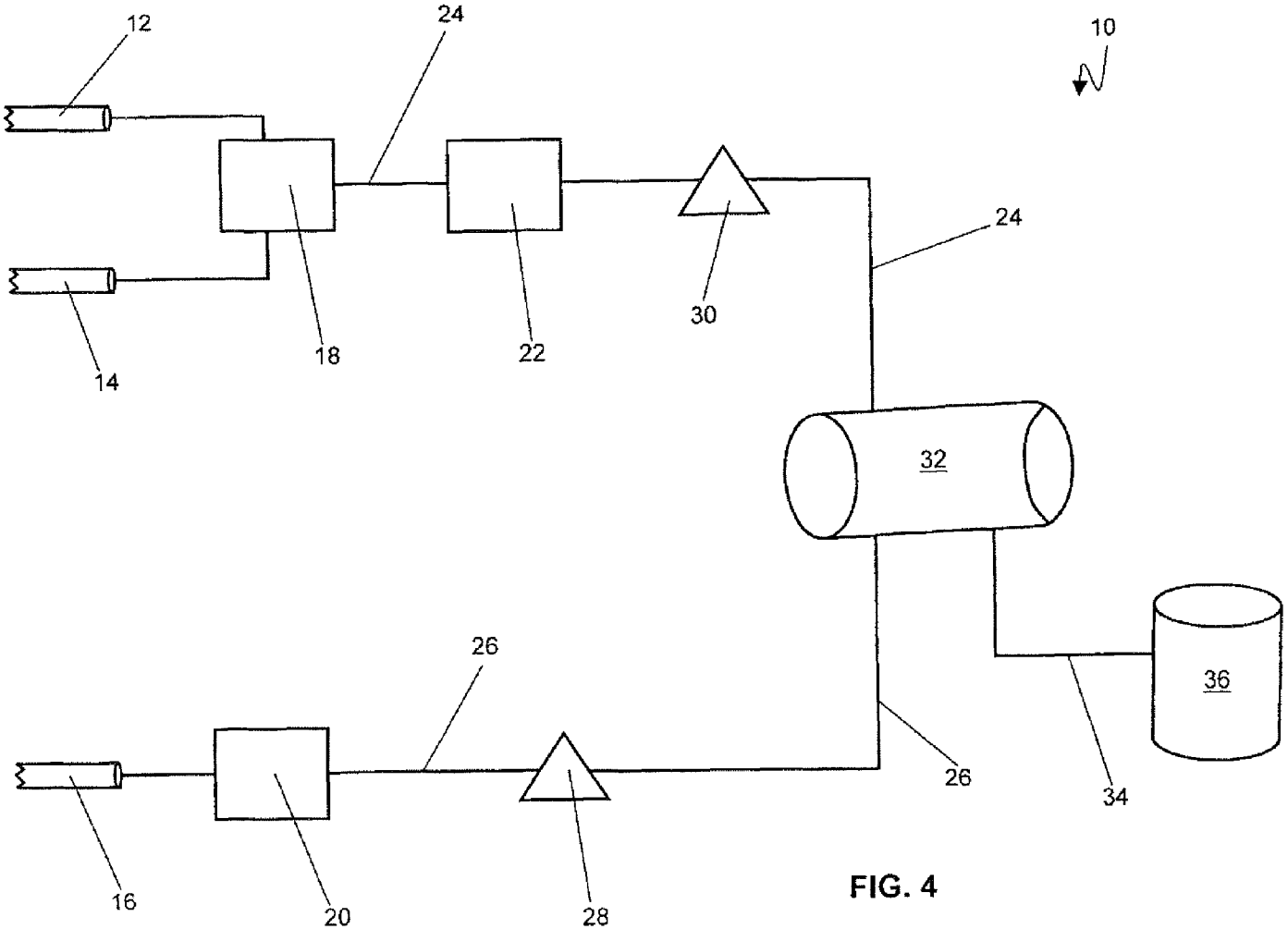
FIG. 4 is a schematic representation of an exemplary manufacturing system for an aqueous fuel emulsion.

FIG. 4 illustrates a schematic representation of a manufacturing system 10 for an emulsion. In the preferred embodiment, the manufacturing system operates at ambient conditions. The manufacturing system 10 comprises a series of inlets for the raw materials. For illustration purposes, inlet 12 provides a hydrocarbon fuel inlet 14 provides an emulsifier package, and inlet 16 provides a source of water and can be connected to the specially designed mixing device 32 at an appropriate place.

Inlets 12 and 14 provide a hydrocarbon fuel and an emulsifier package, respectively, to a fuel pump 18 disposed at the intersection of inlets 12 and 14 with lead 24. The fuel pump 18 transfers the hydrocarbon fuel and the emulsifier package to a mixing station pump 22 at a selected flow rate. The hydrocarbon and emulsifier package would flow at a rate of about 0.87 gallons per minute (gpm) in an emulsifying system with a capacity of about 1 gpm. A flow measurement device 30 is adapted to control the flow of the hydrocarbon fuel and emulsifier package mixture directed from the mixing station pump 22 to the mixing device 32.

Inlet 16 provides a source of water to a water pump 20 through lead 26. The water pump 20 directs the source of water through a flow measurement device 28. The flow of water is then transferred to the specially designed mixing device 32 at a selected flow rate. The water would flow at a rate of about 0.13 gpm in an emulsifying system with a capacity of about 1 gpm.

After flowing through the flow measurement devices, leads 24 and 26 direct the materials to the specially designed mixing device 32. The materials may be transferred using existing pumps (as illustrated), using additional pumps (not shown), by gravity, or by other methods known in the art.

Following creation of the emulsion, the emulsion can be used immediately after manufacture or directed through a lead 34 to a holding tank 36 for future use.

The above-described blending system is particularly suited for preparing a water blend fuel or aqueous fuel emulsion. Specifically, fuels such as hydrocarbon petroleum fuels, blends of hydrocarbon petroleum fuels, blends of hydrocarbon fuels with derivatives of bio mass, derivatives of biomass, and other forms of calorific bearing liquids. The preferred volumetric ratio of calorific bearing liquid to water is about 50% to about 99% of the total volume of the aqueous fuel emulsion. The volumetric ratio of additives is less than about 1% to about 5% of the total volume of the hydrocarbon fuel. The fuel emulsion additives used in the above description can be the following ingredients (or combinations thereof) including surfactants, emulsifiers, detergents, defoamers, lubricants, corrosion inhibitors, anti-freeze inhibitors such as alcohol, and the like.

A mixing device is disclosed. The mixing device relies on a shearing environment where the amount of mixing energy as defined by Equation 2 is about equal at the beginning, middle and end of the mixing geometry. By extending the amount of area in contact with the ingredients, the process has effectively increased the shear force by increasing the variable A in Equation 2. With no moving parts this consistent mixing rate is ensured so long as the flow rates are maintained constant. In this example, the velocity profile, the distance between the two stationary plates, was designed based on the particular flow rate of the system illustrated in FIG. 3. It is understood that the velocity profile or shear forces could easily be increased or decreased based on the desired volume output of the aqueous fuel blending system. Similarly, the shear forces could be changed by using any of a range of different environments which provide a consistent environment for mixing such as narrowing the space between the two surfaces or bending the path of flow.

A method for manufacturing an aqueous fuel emulsion is also disclosed. The method comprises blending a flow of a liquid hydrocarbon fuel with a flow of an emulsifier package and a flow of water to form a first mixture. Next, the method comprises directing the first mixture into a mixing vessel and mixing the first mixture to form the aqueous fuel emulsion. The mixing vessel incorporates the specially designed mixing device, which relies on a shearing environment where the amount of mixing energy as defined in the shear rate is about equal at the beginning, middle and end of the mixing process.

Figure 5:
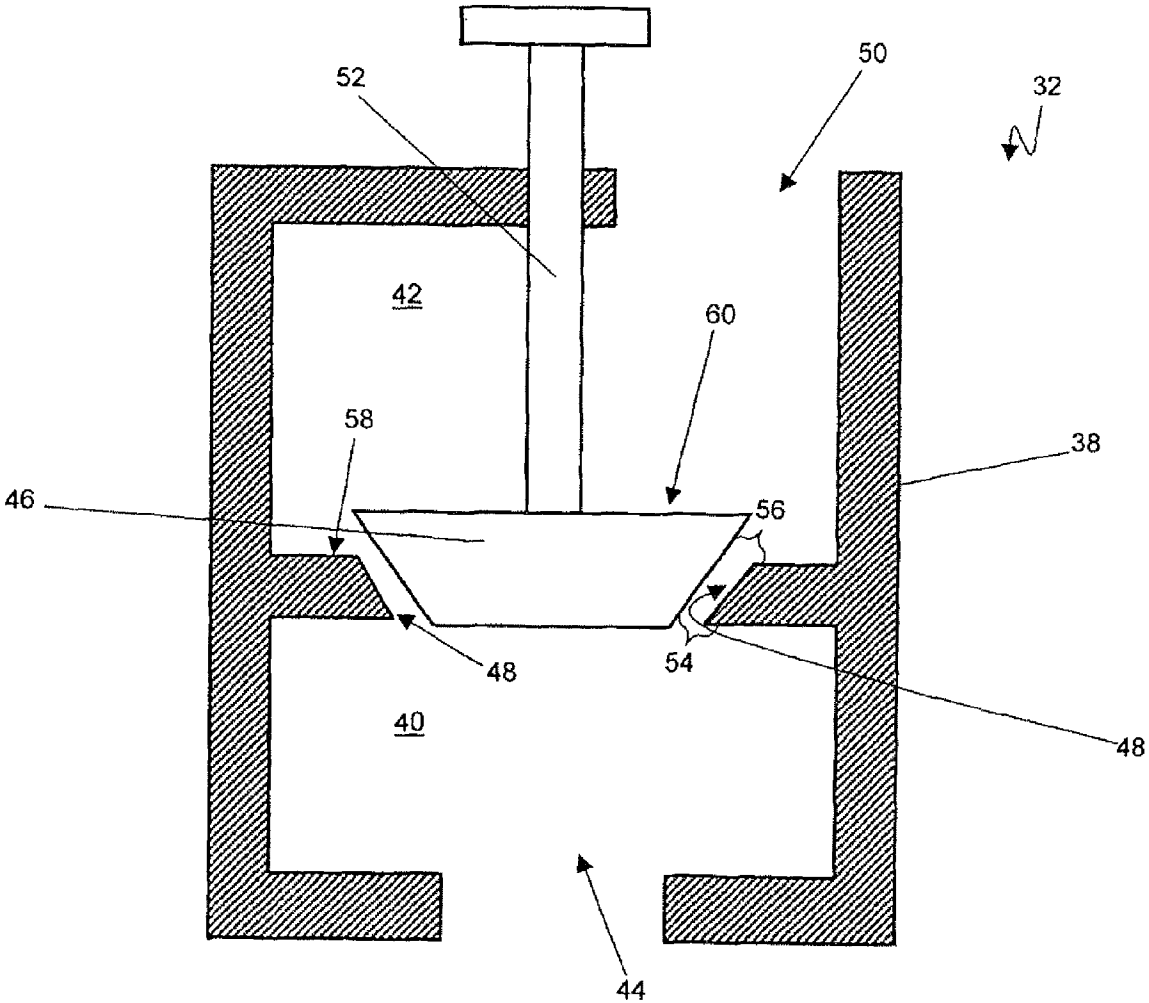
FIG. 5 is a cross section of an exemplary mixing device.

FIG. 5 illustrates a schematic representation of an exemplary mixing device 32. In the preferred embodiment, the mixing device 32 is a plastic or metal device. The mixing device 32 is preferably a metal material that is non-corrosive to the liquids encountered when utilizing the mixing device 32. The mixing device 32 preferably operates at ambient conditions.

With reference to FIG. 5, the mixing device 32 is composed structurally of a fluid shear generator body 38 having two cavities 40, 42 that are open for the transfer of liquids through the fluid shear generator body 38. The fluid shear generator body 38 has an inlet 44 in a first cavity 40 for the liquids to be passed into the fluid shear generator body 38. The liquids pass through the first cavity 40 to the second cavity 42 through a shear cone 46 and shear cone seat 48. The liquids are mixed and passed through an outlet 50 of the second cavity 42 to the end use or storage (not shown).

Within the center of the fluid shear generator body 38 between the first cavity 40 and the second cavity 42, is the shear cone 46. The shear cone 46 is adjusted by the control stem 52 to control the distance (or gap) 54 between the shear cone 46 and the shear cone seat 48.

The shear cone 46 and the shear cone seat 48 are designed such that the gap 54, the distance between the shear cone 46 and the shear cone seat 48 are equal to the gap 56. The height of the gap 54 may be varied by adjusting the shear cone 46 with the control stem 50 by means of a set-screw in a manual mechanism, and the like, or in more automated versions with a hydraulic or pneumatic pump (not shown), and the like.

The size of the shear cone 46, the shear seat 48, and the gap 54 is dependent upon the flow rate of the liquids to be processed in the fluid shear generator body 38. For example, at a flow rate of about 1 gallon per minute (gpm), the shear cone 46 is about 0.15 inches in height with a diameter of about 0.23 inches to about 0.31 inches. The shear cone 46 is sized such that when the control stem 52 is adjusted to set the shear cone 46 in the shear cone seat 48 so that the shear cone 46 is completely flush with the upper surface 58 of the shear cone seat 48. The shear cone seat 48 is always parallel to the shear cone surface 60.

Figure 7:
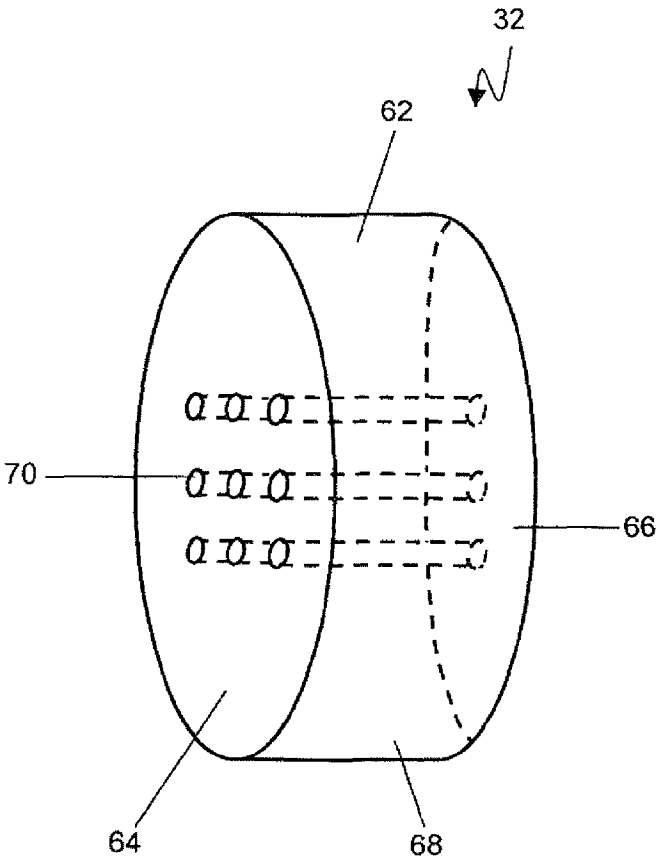
FIG. 7 is a side view of the exemplary mixing device of FIG. 6.
Figure 6:
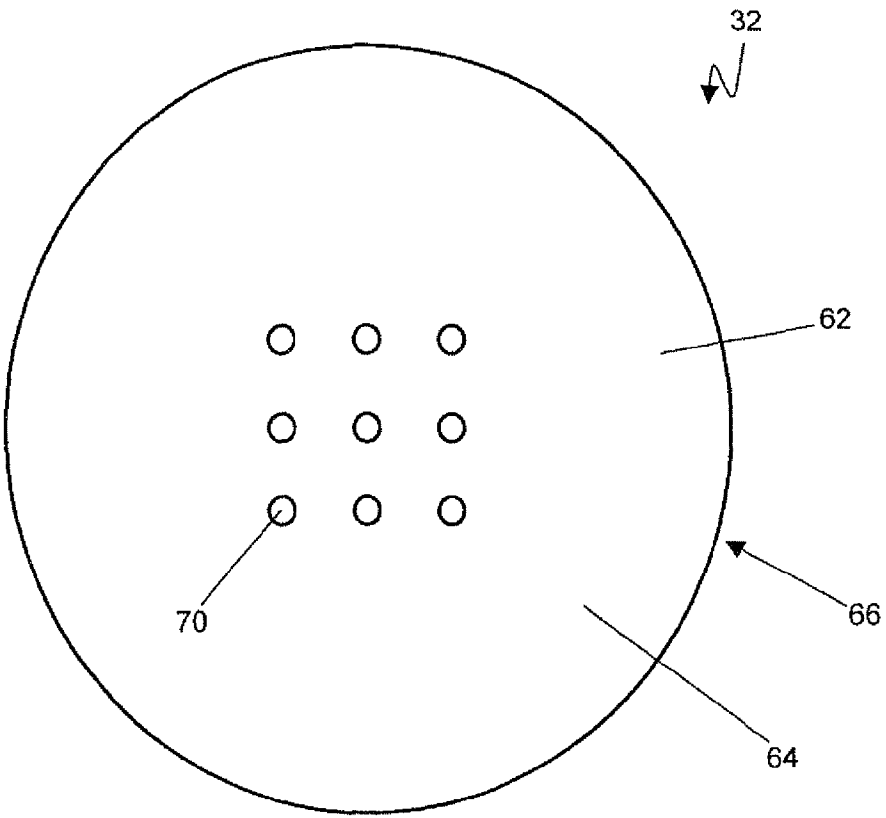
FIG. 6 is a frontal view of another exemplary mixing device.

The mixing device 32 illustrated in FIGS. 6 and 7 is composed structurally of a disc body 62 having a first face 64 and a second face 66. Between the first face 64 and the second face 66 is a disc wall 68. The disc body 62 has several flow passages 70 extending through the disc body 62 from the first face 64 to the second face 66 along a substantially straight line. The flow passages 70 have a constant flow area and provide a substantially straight flow path through the disc body 62. As can clearly be seen from an examination of FIGS. 6-7, the flow path is free from structure that would provide an impact surface for the mixture of aqueous fuel emulsion-producing liquids.

The mixing device 32 illustrated in FIGS. 6 and 7 is composed structurally of a disc body 62 having a first face 64 and a second face 66. Between the first face 64 and the second face 66 is a disc wall 68. The disc body 62 has several flow passages 70 extending through the disc body 62 from the first face 64 to the second face 66. The flow passages 70 have a constant flow area.

The size of the disc body 62 and flow passages 70, and the number of flow passages is dependent upon the flow rate of the liquids to be processed in the disc body 62. For example, at a flow rate of 10 gpm, the disc body 62 can have 110 flow passages 70 having a diameter of about 0.03 inches. The disc body 62 can be about 1 inch thick. The size of the disc body 62 can be extended by making the disc body 62 thicker or by utilizing several disc bodies stacked upon one another.

Figure 1:
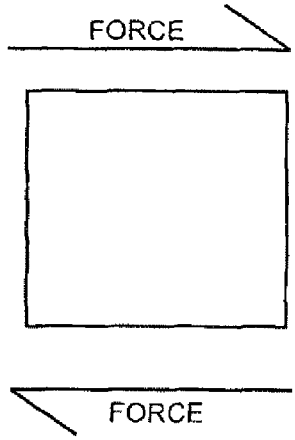
FIG. 1 Prior Art
FIG. 1 is a prior art figure illustrating shear force.
Figure 2:
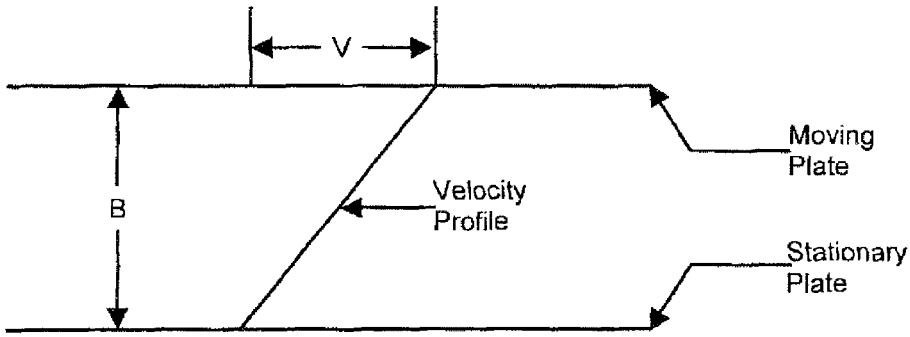
FIG. 2 Prior Art
FIG. 2 is a prior art figure illustrating the shear formula used for analysis of the physical processes in making emulsified fuels between a moving surface and a stationary surface.
Figure 3:
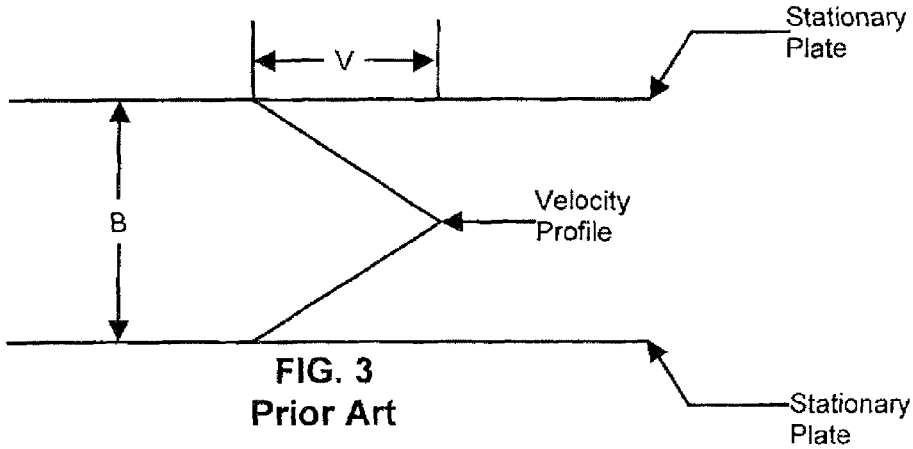
FIG. 3 Prior Art
FIG. 3 is a prior art figure illustrating the shear formula used for analysis of the physical processes in making emulsified fuels between two stationary surfaces.

Referring to FIGS. 5 and 6, the mixing device 32 relies on a shearing environment where the amount of mixing energy as defined in the shear rate is about equal at the beginning (gap 54), middle and end (or the gap 56) of the mixing process. By extending the length of time the ingredients are exposed to a consistent mixing environment, the process has effectively increased the shear force by increasing the variable V in Equation 2. With no moving parts, this consistent mixing rate is ensured so long as the flow rates are maintained constant. In FIG. 3, the velocity profile, the distance between the two stationary plates, was designed based on the particular flow rate of the system illustrated in FIG. 5.

It is understood that the velocity profile or shear forces could easily be increased or decreased based on the desired volume output of the aqueous fuel blending system. Similarly, the shear forces could be changed by using any of a range of different environments that provide a consistent environment for mixing. For example, multiple tunnels could be introduced rather than a single tunnel. This could increase the capacity as well as the amount of mixing depending on various factors well known to those in the art. Alternatively, the straight tunnels could be bent or curved in a variety of ways to enhance the mixing energy.

The above-described apparatus can be used to create an aqueous fuel emulsions with consistently uniform dispersed phase particle sizes. Aqueous fuel emulsion producing liquids are disposed into a mixing device. Any of the mixing devices as discussed above can be utilized. The aqueous fuel emulsion-producing liquids are transported through a constant flow area of the mixing device. The flowing of the liquids through the mixing devices creates an aqueous fuel emulsion having consistently uniform dispersed phase particle sizes.

Example 1

In this example, the Rotor Stator Mixer used is a Silverson™ model 150 L with a fine mesh screen (having a hole size of about 0.02") powered by a 60 HZ motor at about 100%. The individual ingredients and aqueous fuel emulsion were subjected to recirculation within the rotor stator mixing five times. At the end of each pass, a sample was taken for measurement.

The mixer used is illustrated in FIG. 5. The individual ingredients and aqueous fuel emulsion was moved at a rate of 1 gpm and the height of the gap was about 0.03 in. The individual ingredients of the aqueous fuel emulsion were subjected to the specifically designed mixer mixing one time. A sample from the first pass was taken for measurement.

The aqueous fuel emulsion was prepared under the general method described previously with the constituents also described. The particle sizes of the discontinuous phase (or the water) were measured by an accoustizer. Referring to Tables 1 and 2, the accoustizer provided measurements of the water particles suspended for four data points. The first data point is D10, which quantifies the percentage of particles under a given micron size relative to the entire population of discontinued particles. For example, 10% of the particles measured will be less than the D10 reading while 90% will be larger than the D10 reading. The second data point is D50 which quantifies the percentage of particles under a given micron size relative to the entire population of discontinued particles. The third data point is D90, which quantifies the percentage of particles under a given micron size relative to the entire population of discontinued particles. The fourth data point is the mean of all the data points, which is the average size of all particles measured.

TABLE 1

| Rotor Stator Mixer | d10 | d50 | d90 | mean |
|---|---|---|---|---|
| Pass 1 | 0.1713 | 0.8743 | 4.4636 | 2.075 |
| Pass 2 | 0.1240 | 0.6211 | 3.1102 | 1.445 |
| Pass 3 | 0.1523 | 0.7500 | 3.6937 | 1.716 |
| Pass 4 | 0.1593 | 0.7200 | 3.2548 | 1.514 |
| Pass 5 | 0.1509 | 0.7015 | 3.2599 | 1.515 |

TABLE 2

| Present Invention Mixer | d10 | d50 | d90 | mean |
|---|---|---|---|---|
| Pass 1 | 0.1223 | 0.4935 | 1.9920 | 0.934 |

The objective of this example is to match the two mixing devices with an equal amount of energy and shearing as best as could be determined using the previously described formula in Equation 2.

The aqueous fuel emulsion product made by the specifically designed mixing device had a mean size that was generally smaller when compared to the rotor stator shear mixing device with other variables such as flow rate and temperature being constant. In addition, the specifically designed mixer demonstrated that a single pass is generally sufficient to achieve particle sizes that are smaller when compared to multiple passes of the other mixing devices. It is believed although not confirmed that this relates to the extended time in which the liquid is subjected to mixing in the chamber.

The specifically designed mixing device involves less processing time and less energy. Furthermore, the specifically designed mixing device creates a more narrow population of particle sizes, which will allow for a more efficient distribution of the emulsifier package, as well as a more stable aqueous fuel emulsion.

Rotor stators basically provide shearing by a combination of a spinning blade, force through a screen and/or a combination of both. Because the particle size of the discontinuous phase is largely determined by the shear rate of the high shear mixer, it is common for the discontinuous phase to have a wide range of particle sizes. Some of the particles are cut with the blade, some of the particles are forced through a screen and some of the particles are a combination. This is demonstrated in Table 1, which illustrates the three different shearing environments to which the water source, the emulsifying package and liquid hydrocarbon solutions are subjected. Additionally, it is believed although not confirmed, that the larger variance in the particle distribution curve as noted above supports this notion. In fact, as the emulsified fuel is re-circulated through the rotor stator the population of larger particles generally becomes smaller with each pass while the population of smaller particles remains relatively unchanged. Consequently, it appears that the recirculation is reducing the larger population of particles disproportionately to the populations of smaller particles. By way of example, the smallest population of particles (or D10) decreased by only about 12% while the medium population (or D50) decreased by about 20% and the largest population decreased by about 27%.

To compensate for this occurrence many high shear mixers include dual and multiple-staged rotor mixers or looped circuits, which allow emulsion ingredients to be subjected to additional shear thereby increasing the population of uniform water particle sizes. This was proven in Example 1 because after one pass about 90% of the particles were about 4.5 microns or less but after five passes about 90% of the particles were about 3.25 microns or less. However, these additional high shear mixing devices or looped systems are more expensive and less efficient in terms of volume output and overall effectiveness in reducing the particle size of the discontinuous phase.

The mixing apparatus of the present invention is less expensive to manufacture and operate. The simplicity of the operation of the mixing apparatus is desirable because there are no moving parts that can result in costly failures of the apparatus. The resulting emulsion is a more cost-effective and stable fuel.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed:

1. An apparatus for producing aqueous fuel emulsions with consistently uniform dispersed phase particle sizes, the apparatus comprising:

one or more inlets for providing one or more mixture components of a flow of a mixture of aqueous fuel emulsion-producing liquids; and a mixing device that is directed to receive the flow, the mixing device comprising:

a solid body comprising:

a first face, a second face opposite the first face, and a plurality of flow passages extending therethrough from the first face to the second face, each of the plurality of the flow passages having a diameter and presenting a constant flow area through the solid body from the first face to the second face;

a flow measurement device for measuring and controlling a flow rate of the flow from one or more of the inlets to the mixing device, wherein the mixture of aqueous fuel emulsion producing liquids through the plurality of flow passages is provided at a constant flow rate, and wherein the constant flow rate is selected in relation to the diameter to generate within the plurality of flow passages a shear force on the mixture of aqueous fuel emulsion-producing liquids sufficient to emulsify the mixture of aqueous fuel emulsion-producing liquids.

2. The apparatus of claim 1, wherein the solid body is formed from plastic or metal material.

3. The apparatus of claim 1, wherein the flow passages are free from structures that would provide an impact surface for the mixture of aqueous fuel emulsion-producing liquids.

4. The apparatus of claim 1, wherein the flow passages are substantially straight.

5. The apparatus of claim 1, wherein an aqueous fuel emulsion having consistently uniform dispersed phase particle sizes emerges from the plurality of flow passages.

6. The apparatus of claim 5, further comprising a holding tank, wherein the aqueous fuel emulsion is directed from the mixing device to the holding tank.

7. The apparatus of claim 1, wherein the inlets include an inlet for providing a hydrocarbon fuel.

8. The apparatus of claim 1, wherein the inlets include an inlet for providing an emulsifier package.

9. The apparatus of claim 1, wherein the inlets include an inlet for providing water.

10. The apparatus of claim 1, further comprising one or more pumps to direct the flow of mixture components from the inlets.

11. The apparatus of claim 1, further comprising one or more additional solid bodies.

* * * * *